US005339581A

United States Patent [19]

Schlickenmeyer

[11] Patent Number: 5,339,581

[45] Date of Patent: Aug. 23, 1994

[54] MODULAR DECK FLOORING SYSTEM

[76] Inventor: Glen A. Schlickenmeyer, 7502 W. Tuckaway Creek Dr., Franklin, Wis. 53132

[21] Appl. No.: 860,982

[22] Filed: Mar. 31, 1992

[51] Int. Cl.[5] ..... F16S 3/02

[52] U.S. Cl. ..... 52/177; 52/581; 52/480; 52/660

[58] Field of Search ..... 52/180, 177, 87, 390, 52/391, 392, 233, 562, 79.6, 262, 263, 480, 660, 664, 581

[56] References Cited

U.S. PATENT DOCUMENTS

| | | | |
|---|---|---|---|
| 3,703,059 | 11/1972 | Kessler | 52/177 |
| 3,735,549 | 5/1973 | Shuart | 52/262 |
| 3,921,350 | 11/1975 | Van Schoyck | 52/180 |
| 4,008,548 | 2/1977 | Leclerc . | |
| 4,198,795 | 4/1980 | Barnidge . | |
| 4,226,064 | 10/1980 | Kraayenhof . | |
| 4,244,768 | 1/1981 | Wiechowski et al. . | |
| 4,244,768 | 7/1986 | Wiechowski et al. . | |
| 4,691,484 | 9/1987 | Wilson | 52/79.6 |
| 4,712,340 | 12/1987 | Sogge . | |
| 4,745,710 | 5/1988 | Davis | 52/660 X |
| 4,791,763 | 12/1988 | Koutzaroff . | |
| 4,807,412 | 2/1989 | Frederiksen . | |
| 4,885,882 | 12/1989 | Forshee | 52/177 |
| 4,907,387 | 3/1990 | Turnbull | 52/177 |
| 4,928,471 | 5/1990 | Bartley | 52/664 |
| 5,230,186 | 7/1993 | Hammonds | 52/263 X |

FOREIGN PATENT DOCUMENTS

| | | |
|---|---|---|
| 2366418 | 9/1976 | France . |
| 598869 | 2/1948 | United Kingdom . |
| 2028389 | 3/1980 | United Kingdom . |

OTHER PUBLICATIONS

Ortho Books, How to Design and Build Decks & Patios, 1979, p. 63.

*Primary Examiner*—Carl D. Friedman
*Assistant Examiner*—Beth A. Aubrey
*Attorney, Agent, or Firm*—Andrus, Sceales, Starke & Sawall

[57] ABSTRACT

A deck floor system for use in constructing a patio deck consists of a series of individual modules, each secured as a unit to the floor joists. Each module is constructed of a series of side-by-side floor members. The floor members are secured together into the module by threaded fasteners, which extend through spacers located between each floor member.

14 Claims, 2 Drawing Sheets

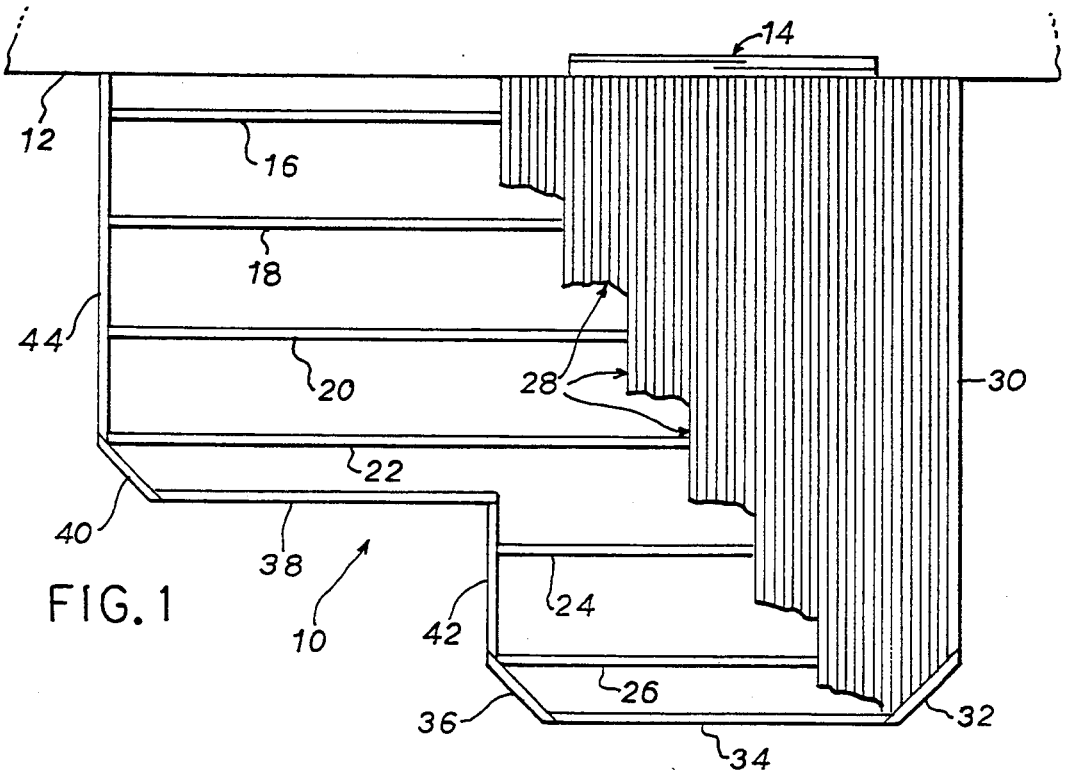
FIG. 1
FIG. 3
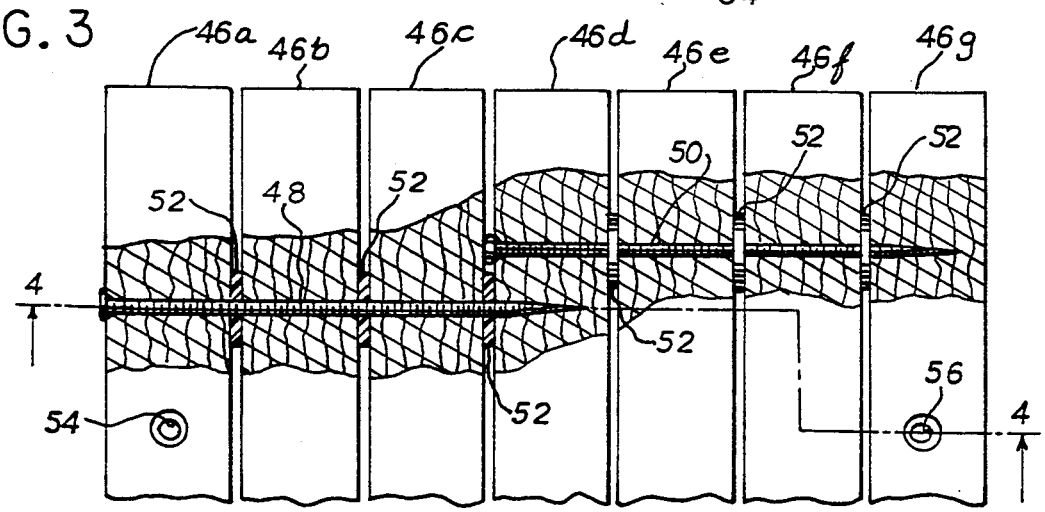
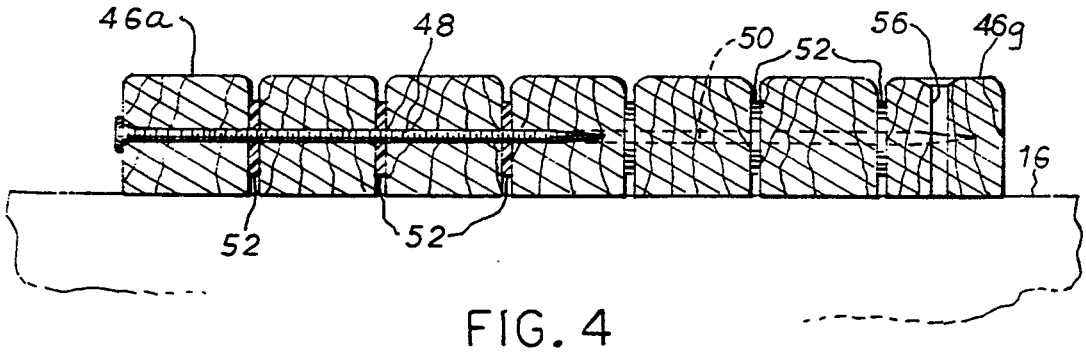
FIG. 4

MODULAR DECK FLOORING SYSTEM

BACKGROUND AND SUMMARY

This invention relates to a system for constructing a deck floor.

In recent years, patio decks have become an increasingly popular feature for home improvement and for new residential construction. A patio deck is typically constructed by anchoring posts into the ground, securing floor joists to the posts, and then securing the deck floor to the floor joists. The deck floor typically consists of individual floor members, such as 1×2s, 2×4s or the like, each of which is individually secured to each floor joist. The floor members are typically nailed or screwed into the floor joists, with the result being that the heads of the nails or screws are located at the upper surface of each floor member. In the case of screws, the screw holes can be countersunk to accept the screw head, and the hole thereafter filled in with wood filler or the like. This is disadvantageous in that it requires several extra steps in construction, and also makes it difficult to remove the floor members after they have been installed. In the case of nails, the nails can be sunk and the holes filled, but this again results in extra steps in construction. In each case, with wood filler being used, it is difficult to match the color of the filler to that of the wood, thus detracting from the overall appearance of the upper surface of the deck floor.

It is an object of the present invention to provide a modular deck flooring system which is extremely easy to install, and which also possesses numerous advantages over prior art deck floors, including an increase in the span between joists, a decrease in maintenance and a more aesthetically appealing upper surface of the deck floor.

In accordance with the invention, a deck floor for a deck including a series of spaced joists is constructed of a series of individual floor modules, each of which is individually secured as a unit to the joists. Each module is constructed of a series of elongated floor members, which are secured together to for the module. The floor members in each module are spaced apart from each other. In each module, the floor members are secured together by threaded fasteners located at spaced locations along the length of the floor members. The threaded fasteners extend transverse to the longitudinal axes of the floor members at each location. In a preferred form, each module consists of first and second end members, a central member, and one or more intermediate members located between the central member and each end member. A pair of threaded fasteners are provided at each location along the length of the floor members. A first one of the threaded fasteners interconnects the central member with the first end member and the intermediate members therebetween, and a second one of the threaded fasteners interconnects the central member with the second end member and the intermediate members therebetween. In a preferred arrangement, the end members and intermediate members are all anchored onto the central member. The floor members in each module are spaced apart from each other by a series of spacers, each of which is located between adjacent floor members. The threaded fasteners extend through the spacers to interconnect the floor members, the fasteners, and the spacers into an integral module. Each module is secured to the joists, at the location of each joist, by threaded screws which extend through only selected ones of the floor members, to anchor the module as a unit to the joist. For instance, the end member of each module may be fastened to the joist, and it is not necessary to anchor any other of the floor members to the joist. This substantially reduces the number of fasteners which must be used to secure the floor members to the joists, resulting in a deck floor which has an upper surface much less interrupted than when conventional screws or nails are used. In the invention, the screw heads are countersunk, and the area above the screw head is filled in with sawdust. The sawdust can be removed if necessary to allow access to the screw head, in the event it becomes necessary to remove the floor module for any reason.

The invention further contemplates an individual floor module constructed as summarized above, and a method of constructing a deck floor, also substantially according to the foregoing summary.

Various other objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is a plan view of a partially constructed deck showing a series of floor modules constructed according to the invention mounted to the floor joists;

FIG. 3 is a partial top plan view of the floor module of FIG. 2, with portions broken away to show the manner in which the floor members are interconnected;

FIG. 4 is a section view taken generally along line 4—4 of FIG. 3.

DETAILED DESCRIPTION OF THE PREFERRED EMBODIMENT

Figure 2:
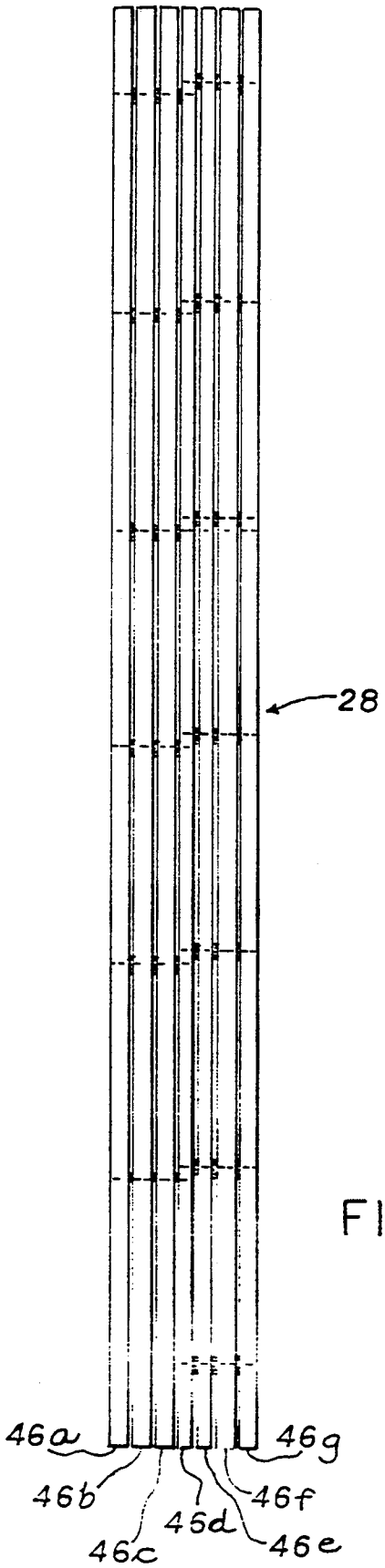
FIG. 2 is a plan view of an individual floor module for use in constructing a deck, such as that shown in FIG. 1.

FIG. 1 illustrates a deck 10 extending outwardly from the side of a house, shown at 12. A patio door 14 is provided in the wall of house 12 for providing access to deck 10 from the interior of house 12.

Deck 10 includes an understructure consisting of a series of posts (not shown) anchored into the ground. A series of parallel joists 16, 18, 20, 22, 24 and 26 are mounted to the posts, with each being parallel to the side of house 12. Joist 16 is spaced approximately 12 inches from the side of house 12, and the center-to-center spacing of joists 16–26 is approximately 50 inches.

A series of four modules 28, constructed according to the invention, are mounted to joists 16–26. Modules 28 are identically constructed, in a manner to be explained. Each of modules 28 is butted up against the side of house 12, and is secured to each of joists 16–26. The outer end of each module 28 is trimmed to provide the final top plan configuration for deck 10.

An edge board 30 is fastened to the side of the rightwardmost module 28, and also to the rightward ends of joists 16–26. An angled edge board 32 is mounted to the trimmed end of the rightwardmost module 28. Edge boards 34, 36, 38 and 40 are also mounted to the ends of modules 28. Edge board 42 is mounted to the ends of joists 24 and 26, and to the rightward end of edge board 38, and edge board 44 is mounted to the ends of joists 16–22.

It should be understood that modules 28 overhang joists 22 and 26 approximately 18 inches. In this manner, the posts to which the joists are mounted can be concealed by the overhanging portion of modules 28.

Each module 28 is constructed as shown in FIGS. 2–5. Referring to FIG. 2, each module 28 includes seven side-by-side floor members **46*a*–46*g* secured together with a space between each adjacent floor member. Floor members 46*a*–46*g*** are secured together by a pair of fasteners at seven spaced locations along the length of each floor member.

Each of floor members **46*a*–46*g* is a 2 inch×2 inch nominal member having a length of approximately 16 feet. As is known, a nominal 2 inch×2 inch member is in fact $1\frac{5}{8}$th inches×$1\frac{5}{8}$th inches in cross section. Members 46*a*–46*g* are southern yellow pine #1 dense select, and are pressure-treated with a water repellant substance. This type of member is available from Elderwood Preservatives of Mansura, La. under the designation "Ultrawood". The grain in each of members 46*a*–46*g*** is oriented vertical in order to obtain maximum strength of each member.

While the above material has been found satisfactory, it is understood that any type of material, of any dimension, could be employed to construct modules 28.

In FIG. 3, the end floor members are shown at **46*a*, 46*g*. The central floor member is shown at 46*d*. A pair of intermediate floor members 46*b*, 46*c* are located between end member 46*a* and central member 46*d*, and a pair of intermediate members 46*e*, 46*f* are located between end member 46*g* and central member 46*d***.

A pair of threaded screws interconnect floor members **46*a*–46*g* at each of the seven spaced locations along the length of members 46*a*–46*g*. A representative pair of threaded screws 48, 50 are shown in FIG. 3, located toward one end of members 46*a*–46*g***.

Wood screws 48–50 are 6 inch long self-tapping wood screws with bugle heads having square drives. Such screws are commonly available from building supply establishments. Screws 48, 50 each extend through plastic spacers or washers 52. Washers 52 include a central opening through which screws 48, 50 extend. Washers 52 are constructed of a polymeric plastic material, and are approximately $\frac{1}{8}$th inch thick×$\frac{3}{4}$ inch in diameter.

Figure 5:
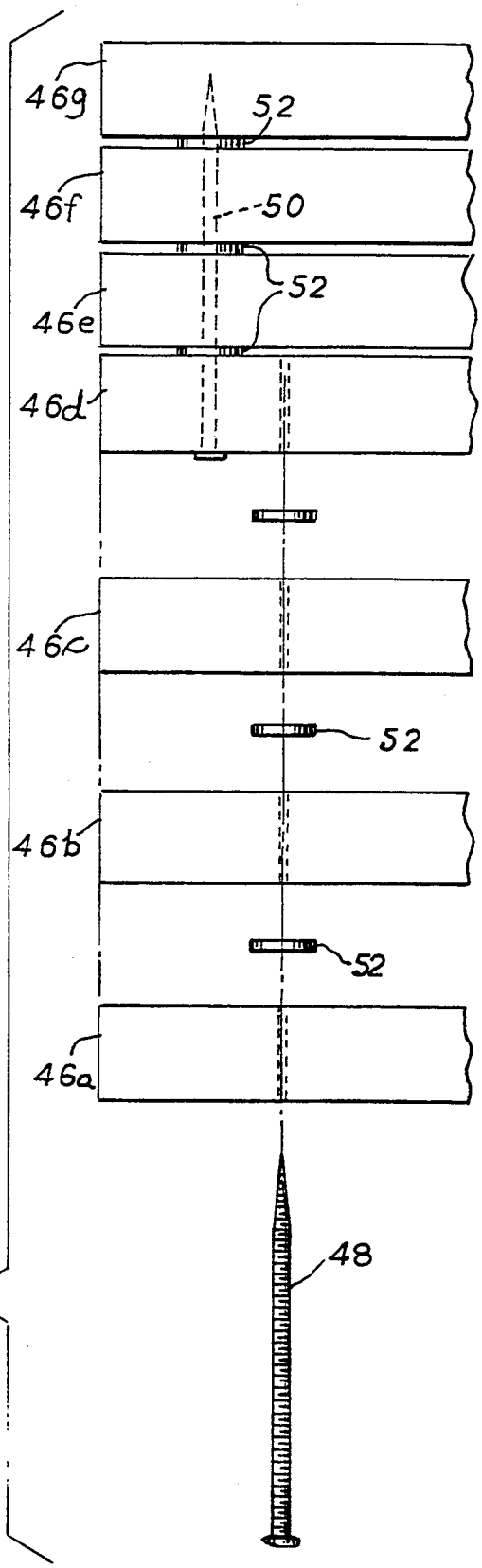
FIG. 5 is a partial top plan view showing the manner in which the floor members in each module are constructed together into a module.

Referring to FIG. 5, members **46*a*–46*g* are assembled as follows. First, a hole is drilled through central member 46*d* in a location near the end of member 46*d*. Spacers 52 are then placed between members 46*d*, 46*e*; 46*e*, 46*f*; and 46*f*, 46*g*, with the opening in each spacer in alignment with the hole which has been drilled sideways through member 46*d*. A power-operated square head screwdriver is then employed to drive screw 50 through the predrilled hole in central member 46*d*, and through spacer 52 between members 46*d* and 46*e*. The self-tapping action of screw 50 then allows screw 50 to bore sideways through member 46*e*, and to emerge therefrom through spacer 52, located between member 46*e* and 46*f*, and then into member 46*f*. Continued driving of screw 50 results in screw 50 boring through member 46*f* and through spacer 52, located between members 46*f* and 46*g*, and partially into member 46*g*. The bugle head of screw 50 seats itself substantially flush into the side of member 46*c*. Thereafter, the user predrills a hole sideways through member 46*a*, and the steps described above are repeated so that screw 48 is driven through the hole in member 46*a*, and self-taps through members 46*b* and 46*c*, and through spacers 52 located therebetween, and partially through member 46*d***.

With the above construction, members **46*a*, 46*b* and 46*c* are anchored onto central member 46*d*, as are members 46*e*, 46*f* and 46*g***.

The above-described steps are repeated at each of the seven equally spaced locations along the length of members **46*a*–46*g*, to secure members 46*a*–46*g* together into a module having a width of approximately $11\frac{1}{2}$ inches. The length of module 28 can vary according to the length of each of members 46**, and may be standard lengths such as 8 feet, 10 feet, 12 feet, 14 feet and 16 feet.

Modules 28 are preferably constructed off-site on a table or jig set up specifically for such purpose, as will be apparent to one of ordinary skill in the art. The modules can be prefabricated at any time and stored, and then shipped to the construction site for installation on a deck.

Each module 28 is secured to one of the joists, such as joist 16, in a manner as shown in FIGS. 3 and 4. Referring to FIG. 3, a countersunk hole 54 is drilled top-to-bottom through end member **46*a*, and a similar such hole 56 is drilled through end member 46*g*. A self-tapping screw is driven through each of holes 54, 56 and into joist 16. The head of the screw is received within the countersunk upper end of hole 56, so as to be below the upper surface of floor member 46*g*** by approximately $\frac{1}{4}$ inch. Sawdust is then used to fill the upper portion of the hole above the screw head, to fill in the hole and to blend with the upper surface of the deck. With this construction, two screws, one in each end member, act to secure the module, as a unit, to each joist at the location of the joists. It can thus be appreciated that a much smaller number of fasteners are required to secure the floor modules to the joists than in previous construction in which each individual floor member is secured to each joist. Accordingly, installation of the deck floor can be carried out much more easily and quickly than in the past. Further, the smaller number of fasteners required to mount the modules to the floor joists results in the deck upper surface having far fewer holes drilled, and fasteners used, to secure the modules to the floor joists. This results in a much less interrupted upper surface for the deck floor. In addition, use of sawdust to fill the upper part of the hole results in highly satisfactory blending of the filler material with the surrounding surface.

The substantial increased strength of the floor modules allows the modules to overhang the joists by a certain amount, as shown in FIG. 1. This cantilever provided by the floor material allows the edge boards to hang down therebelow and to conceal the posts, to which the closest joist is secured.

The strength of the deck modules has been calculated, and it has been determined that a 56" span can be employed between joists when using 2×2 floor members of #1 grade southern yellow pine dense select, and a 40 pound per square foot live load.

The deck floor system of the invention lends itself particularly well to use in kits, in which flooring modules of predetermined width and length are supplied, such as through a building center or the like. The modules can be sold along with conventional deck kits, and result in a deck which is easy to construct and yet which provides highly satisfactory appearance and performance.

Various alternatives and embodiments are contemplated as being within the scope of the following claims, particularly pointing out and distinctly claiming the subject matter regarded as the invention.

I claim:

1. A deck floor for a deck including a series of spaced joists, comprising a series of elongated floor members each defining an upper surface and a lower surface adapted to be placed on the joists, wherein the floor members are secured together into individual floor modules each comprising a plurality of individual floor members, wherein the floor members in each module are spaced apart from each other when the members are secured together in the floor module, and wherein the modules are each secured as a unit to the spaced joists, wherein each module comprises first and second end members, a central member, and one or more intermediate members located between the central member and each end member, wherein the floor members in each module are secured together by means of threaded fasteners located at spaced locations along the length of the floor members, the threaded fasteners extending substantially transverse to the longitudinal axes of the floor members, wherein a pair of threaded fasteners are provided at each location along the length of the floor members, wherein a first one of the threaded fasteners interconnects the central member with the first end member and extends through the intermediate members located between the first end member and the central end member, and wherein a second one of the threaded fasteners interconnects the central member with the second end member and extends through the intermediate members located between the second end member and the central member.

2. The floor of claim 1, wherein the first threaded fastener extends completely through the central member and intermediate members and partially into the first end member, and wherein the second threaded fastener extends completely through the second end member and intermediate members and partially into the central member, whereby all of the floor members are secured together and anchored onto the central member.

3. A deck floor for a deck including a series of spaced joists, comprising a series of elongated floor members each defining an upper surface and a lower surface adapted to be placed on the joists, wherein the floor members are secured together into individual floor modules each comprising a plurality of individual floor members, wherein the floor members in each module are spaced apart from each other when the members are secured together in the floor module, and wherein the modules are each secured as a unit to the spaced joists, wherein the floor members in each module are secured together by means of threaded fasteners located at spaced locations along the length of the floor members, the threaded fasteners extending substantially transverse to the longitudinal axis of the floor members, wherein the floor members in each module are spaced apart from each other by means of a plurality of spacers, each of which is located between adjacent floor members, and wherein the threaded fasteners extend through the spacers.

4. A floor module for use in constructing a deck, comprising:

a plurality of elongated floor members;

one or more spacers located between adjacent floor members to space the floor members apart from each other; and a plurality of fasteners interconnecting the floor members and spacers at spaced locations for securing the floor members and spacers into a module, the fasteners extending substantially transverse to the longitudinal axes of the floor members.

5. The floor module of claim 4, wherein each module comprises first and second end members, a central member and one or more intermediate members located between the central member and each end member.

6. The floor module of claim 5, wherein a pair of threaded fasteners are provided at each location along the length of the floor members, wherein a first one of the threaded fasteners interconnects the central member with the first end member and extends through the intermediate members located between the first end member and the central member, and wherein a second one of the threaded fasteners interconnects the central member with the second end member and extends through the intermediate members located between the second end member and the central member.

7. The floor module of claim 6, wherein the first threaded fastener extends completely through the central member and the intermediate members and partially into the first end member, and wherein the second threaded fastener extends completely through the second end member and the intermediate members and partially into the central member, whereby all of the floor members are secured together and anchored onto the central member.

8. The floor module of claim 4, wherein the threaded fasteners extend through the spacers.

9. A method of constructing a floor for a deck including a series of spaced joists, comprising the steps of:

constructing a plurality of individual floor modules by positioning a plurality of elongated floor members adjacent each other; placing one or more spacers between adjacent floor members to define a space located between adjacent floor members; and connecting the floor members and spacers together into a prefabricated floor module by interconnecting the floor members and spacers by means of one or more threaded fasteners extending through the floor members and through the spacers at spaced locations, the threaded fasteners extending substantially transverse to the longitudinal axes of the floor members; and securing each floor module as a unit to the joists, with the floor modules being placed adjacent each other to form a floor.

10. The method of claim 9, wherein the plurality of floor members in each module comprises first and second end members, a central member, and one or more intermediate members located between the central member and each end member, and wherein the step of interconnecting the floor members and spacers at spaced locations comprises interconnecting, at each location, the central member with the first end member and the intermediate members therebetween by means of a first threaded fastener, and interconnecting the central member with the second end member and the intermediate members therebetween by means of a second threaded fastener.

11. The method of claim 10, wherein the first threaded fastener extends completely through the central member, and partially into the first end member, and wherein the second threaded fastener extends completely through the second end member and partially into the central member, whereby all of the floor members are secured together and anchored onto the central member.

12. The method of claim 9, wherein the step of securing each floor module as a unit to the joists comprises connecting selected ones of the floor members to the joist at each location, whereby the floor module is secured as a unit to the joist.

13. The method of claim 9, wherein the step of securing each floor module as a unit to the joists includes placing the floor modules adjacent each other in a side-by-side manner such that the floor modules extend across the joists, wherein a plurality of adjacent floor modules cooperate to make up the deck floor.

14. The method of claim 13, wherein the step of placing the floor modules comprises placing each floor module such that each module extends the entire span of the deck as defined by the joists.

* * * * *